US006919853B2

(12) United States Patent
Jordan et al.

(10) Patent No.: US 6,919,853 B2
(45) Date of Patent: Jul. 19, 2005

(54) MULTI-BAND ANTENNA USING AN ELECTRICALLY SHORT CAVITY REFLECTOR

(75) Inventors: David Frederick Jordan, Danville, NH (US); Thomas S. Laubner, Merrimac, MA (US)

(73) Assignee: M/A-Com, Inc., Lowell, MA (US)

( * ) Notice: Subject to any disclaimer, the term of this patent is extended or adjusted under 35 U.S.C. 154(b) by 0 days.

(21) Appl. No.: 10/090,208

(22) Filed: Mar. 4, 2002

(65) Prior Publication Data

US 2003/0164800 A1 Sep. 4, 2003

(51) Int. Cl.[7] ..... H01Q 13/10; H01Q 1/32
(52) U.S. Cl. ..... 343/770; 343/713; 343/700 MS
(58) Field of Search ..... 343/713, 770, 343/700 MS, 767, 789, 909, 711, 712

(56) References Cited

U.S. PATENT DOCUMENTS

| | | | | |
|---|---|---|---|---|
| 3,312,976 A | | 4/1967 | Gregory | 343/767 |
| 4,775,866 A | | 10/1988 | Shibata et al. | 343/700 |
| 5,959,581 A | | 9/1999 | Fusinski | 343/700 MS |
| 6,043,786 A | | 3/2000 | Vannatta et al. | 343/770 |
| 6,054,953 A | | 4/2000 | Lindmark | 343/700 |
| 6,097,345 A | | 8/2000 | Walton | 343/769 |
| 6,441,792 B1 | * | 8/2002 | Sievenpiper et al. | 343/713 |
| 6,466,176 B1 | * | 10/2002 | Maoz et al. | 343/767 |
| 6,642,898 B2 | * | 11/2003 | Eason | 343/770 |
| 6,664,932 B2 | * | 12/2003 | Sabet et al. | 343/770 |

FOREIGN PATENT DOCUMENTS

| | | | |
|---|---|---|---|
| DE | 197 40 254 A1 | 4/1998 | |
| DE | 100 34 547 A1 | 1/2002 | H01Q/19/10 |

* cited by examiner

*Primary Examiner*—James Vannucci

(57) ABSTRACT

A compact, aesthetically pleasing, multi-band antenna for use in conjunction with communication systems used in automotive applications, comprising a radiating element capable of operating in several frequency bands in combination with an electrically short reflector to provide superior gain characteristics while shielding the interior of the automobile from exposure to high levels of radiated signals.

25 Claims, 3 Drawing Sheets

MULTI-BAND ANTENNA USING AN ELECTRICALLY SHORT CAVITY REFLECTOR

FIELD OF THE INVENTION

The present invention relates to antennas, and more specifically to multi-band antennas for use in the automotive industry.

BACKGROUND OF THE INVENTION

Antennas have been used on automobiles for many years. Originally, antennas were installed on automobiles to allow for reception of signals for the car radio. A whip antenna protruding from one of the vehicle fenders for radio reception was standard on most automobiles. Later, antennas that were either embedded within or affixed to the inside of the windshield of the automobile were developed. These in-glass or on-glass antennas ran around the perimeter of the windshield and were less visible than the whip antennas and less susceptible to damage from external elements such as weather or vandalism.

Today, complicated on-board communication systems are used in the automotive industry. Vehicle manufacturers offer systems with features such as built in telephone communication and global positioning satellite (GPS) systems. With the introduction of these complex systems, there was a corresponding increase in the complexity of the antennas required. These systems require antennas that can both receive and transmit signals on several frequency bands. The Personal Communication Service (PCS) band and the Advance Mobile Phone Service (AMPS) band are the most common frequency bands used in cellular telephone communication, with the PCS band used primarily for digital transmissions and the AMPS band used primarily for analog transmissions. Global positioning satellite systems operate within a third distinct frequency band known as the GPS band.

Several types of antennas have been used in conjunction with these kinds of communication systems. Single pole, dipole and slot antennas are examples of well known types of antennas used. The predominant mode of reception for these systems is vertical polarization. Single pole and dipole antennas provide polarization in the same direction as the orientation of the antenna, while slot antennas provide polarization perpendicular to the orientation of the antenna. For example, a standard single pole or dipole whip antenna would need to be vertically oriented to achieve the desired vertical polarization. A slot antenna would need to be horizontally oriented to provide the desired vertical polarization. Vertically oriented whip antennas have been used on the rooftop, fenders, and rear windshield of vehicles for mobile telephone reception for several years.

While the primary mode of polarization of PCS and AMPS signals is vertical in nature, many providers also offer diversity polarization. Diversity polarization means the signal can be switched between vertical, horizontal, and a form of slant polarization (slant polarization is on an angle between the two) to provide the best coverage in difficult coverage areas. Diversity polarization allows the system to account for the change in polarization resulting from the signal reflecting off of structures and the landscape.

External vertical whip antennas have several disadvantages. First, they are not aesthetically desirable. Also, they are easily susceptible to damage from external forces such as weather, vandalism, and automatic car washes. There exists a desire among vehicle designers to remove the external whip antennas and replace them with on-glass antennas in a manner similar to what had been done previously for radio reception.

On-glass antennas for the complex communication systems used today created a new set of problems. Dipole antennas are unsuitable for on-glass applications for several reasons. First, in order to achieve the desired vertical polarization, the antenna would need to be vertically oriented on the windshield glass. Vertical orientation of this type of antenna on the front windshield is a concern because it causes an obstruction of the vehicle operator's view. In addition, dipole antennas radiate omni-directionally in the plane perpendicular to the antenna axis, including backwards into the passenger compartment. Thus, the vehicle occupants are subject to the signal energy radiated from the antenna. Recently, there has been widespread concern about the possible negative effects of such radiation on humans. Adding some type of reflector shield to prevent RF signals from radiating backward into the passenger compartment is not practicable because of the size of the shield necessary and the obstruction to the operator's view that would result from adding such a shield. Finally, vertically oriented dipole antennas are not receptive to the diversity polarization signals.

Patch antennas with reflectors have been used because of their small size and directional nature; however, while it is desirable to avoid radiation traveling into the passenger compartment, omni-directional radiation outside of the vehicle is preferred for optimum antenna performance. For example, patch antennas by nature have a narrow beam width and as a result do not provide the desired performance for vehicular applications.

SUMMARY OF THE INVENTION

It is desirable to have an antenna that provides superior performance without the limitations of the existing antennas. It is desired to have an antenna unit that is compact in size for aesthetic reasons and to assure that there is no obstruction of the view of the vehicle operator. It is desired that the antenna have complete coverage both in front of the vehicle and vertically above and behind the vehicle to assure high levels of signal transmission and reception. Finally, it is desired that the amount of radiation from the antenna be minimized within the passenger cabin of the vehicle so that the vehicle occupants are not subject to the signal energy.

The present invention provides for a compact multi-band antenna for on-board vehicle communication systems that can be mounted to the front windshield of the vehicle. The physical dimensions of the antenna are small, approximately 8 inches long by 2 inches wide by 1 inch deep. The antenna unit can be mounted at the top of the front windshield of an automobile adjacent to the headliner; and thus out of the normal view of the driver.

The antenna is capable of operating on several frequency bands such as AMPS, PCS, and GPS, allowing the antenna to be used with the complex communication systems utilized in today's vehicles which require multi-band cellular communications or communication with the global positioning satellite network. The antenna is predominantly vertically polarized; however, a significant horizontal component is also present to aid in diversity polarization.

The antenna comprises a radiating element in combination with a reflector. The radiating element contains two slot antennas for use with the AMPS band and PCS band and a patch antenna for use with the GPS band.

The antenna utilizes a reflector cavity to form the back of the antenna unit. The cavity is formed by coupling a reflector to the rear of the radiating element of the antenna. The reflector serves two purposes. First, the reflector focuses the radiated signals in the forward direction, which improves the gain achieved by the antenna. Also, the reflector reflects the signal directed into the passenger compartment, redirecting the signal outside of the vehicle. This prevents the occupants of the vehicle from exposure to the radiated signals.

The cavity depth is extremely electrically short in comparison to what is currently known in the art. In a preferred embodiment, the cavity depth is only one inch. The back wall of the reflector is positioned one inch from the slot antennas contained on the radiating element.

DETAILED DESCRIPTION OF THE INVENTION

Figure 1:
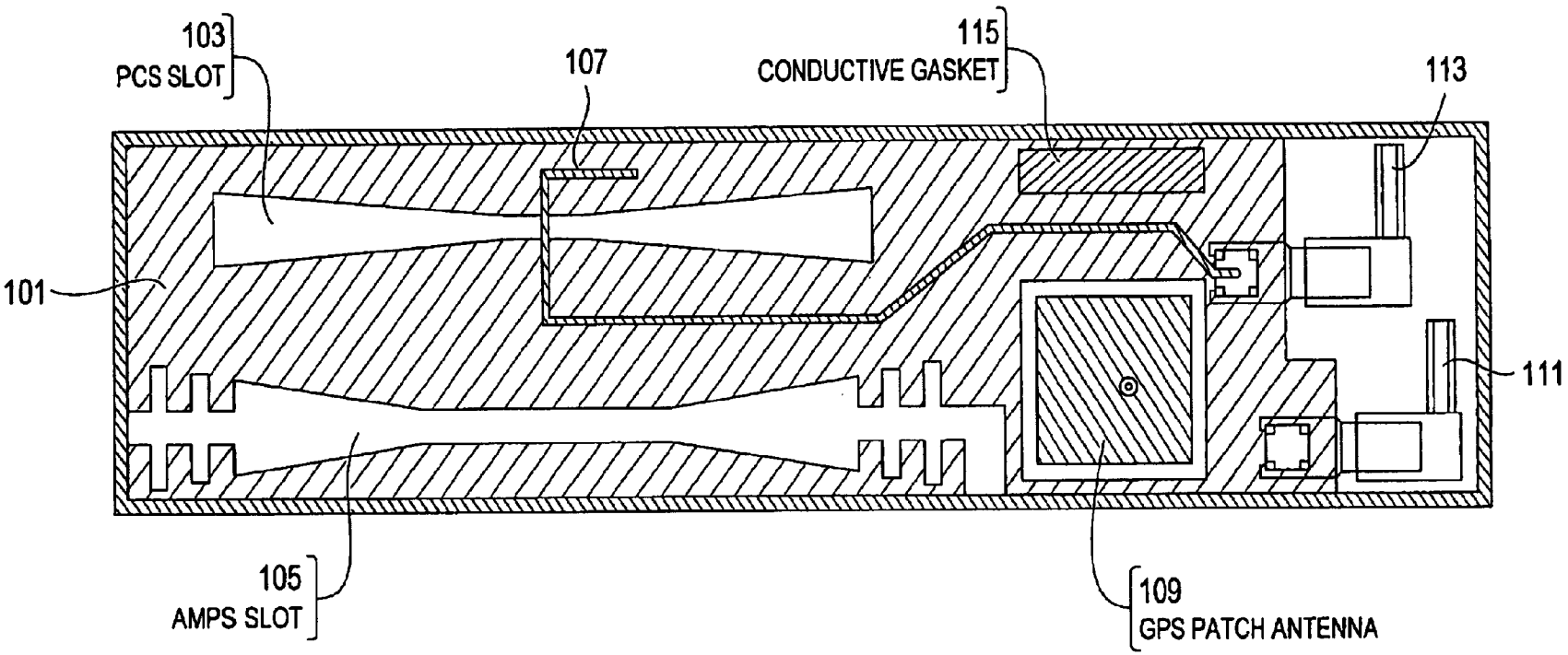
FIG. 1 is a front view of an antenna unit in accordance with the present invention showing the elements and their respective locations on the printed circuit board face of the antenna unit.

The present invention is a small, concealed on-glass antenna for use in the automotive industry. The antenna in accordance with the preferred embodiment of the invention operates in multiple frequency bands. In the preferred embodiment, it comprises two slot antennas and a GPS patch antenna formed on a printed circuit board face. The face is coupled to a reflector to form a rectangular antenna unit with an electrically short cavity contained within the walls of the antenna unit.

In the preferred embodiment, the radiating element of the antenna 101 comprises a conductive printed circuit board material such as FR4 material. The slots (103 and 105) are etched into the printed circuit board material. Other materials can be used to form the antenna radiating element into which the slots are formed. Alternative embodiments can use various conductive metals with slots stamped into the material. However, a printed circuit board material such as FR4 is preferred for two reasons. First, the base FR4 material is a very inexpensive material and is easy to manufacture, thus making FR4 a cost effective choice. Secondly, printed circuit boards allow for any additional electrical components to be formed directly on the printed circuit board material, such as transmission lines or additional circuitry. This allows additional antennas such as a GPS patch antenna 109 to be easily added to the unit.

The preferred embodiment utilizes two slot antennas formed in the printed circuit board material by using an etching process to remove the metalization from the face of the board in the desired areas. A first slot antenna 103 is designed for transmission and reception in the PCS band. A second slot antenna 105 is designed for transmission and reception in the AMPS band. Slot antenna shape and design are well known in the art; thus, no detailed discussion of the form of the slot is included herein.

The slot antennas 103 and 105 are oriented such that they will be in a horizontal position when the antenna is mounted in the vehicle. As a result of such orientation, the desired vertical polarization is obtained. In addition, a horizontal component is present that provides diversity coverage. This component is achieved as a result of the interaction with the reflector and the proximity to the metal roof surface.

The slot antennas are fed via a transmission line 107. The slot antennas can be fed via transmission lines in various configurations. Each slot antenna can be fed by its own transmission line, a single transmission line can be split into two paths to feed both slot antennas, or a single transmission line can drive one slot antenna with the second slot antenna parasitically coupled to the first slot antenna. In the preferred embodiment, a single transmission line 107 is formed to feed the PCS band slot antenna 103. The AMPS band slot antenna 105 is parasitically coupled to the PCS band slot antenna 103 by physically positioning the AMPS band slot antenna 105 in close proximity to the PCS band slot antenna 103. By using parasitic coupling, both slot antennas can be driven by a single transmission line. This method is preferred because it allows the antennas to be positioned closer together on the printed circuit board than they could be if two transmission lines or a single line with two branches were used. This, in turn, allows for the overall width of the antenna unit to be minimized. In the preferred embodiment, the overall width dimension of the antenna unit (defined as the dimension of the edge of the antenna unit that begins at the top of the windshield and travels down the windshield towards the dashboard when the unit is mounted on the vehicle windshield) is less than 2.25 inches. In alternative embodiments, where either two transmission lines or one transmission line with two branches is used to feed the slot antennas, the slots need to be spaced further apart and the width of the unit increases to approximately 3 inches.

The transmission line 107 is printed directly on the printed circuit board material. Alternative embodiments can use a wire or cable to achieve this function; however, in the aforementioned preferred embodiment, no additional discrete parts are necessary. The transmission line 107 is formed directly on the circuit board by printing a conductive path leading from a terminal contact 113 to the PCS slot antenna 103. This configuration allows the PCS slot antenna 103 and the AMPS slot antenna 105 to be connected to the system with which it is being used by simply plugging the cable from the system into a terminal contact 113 contained within the antenna unit.

In addition to the two slot antennas, the preferred embodiment contains a third antenna for use with the GPS band. A GPS patch antenna 109 is located on the printed circuit board material. This type of patch antenna is well known in the art; thus, no detailed discussion of the patch antenna is included herein. The GPS patch antenna 109 enables the antenna unit in accordance with the present invention to operate in a third frequency band. This allows the antenna unit to be used with systems utilizing the most common digital and analog cellular bands and also to be used to communicate with the network of global positioning satellites.

In the preferred embodiment, the GPS patch antenna 109 and the slot antennas (103 & 105) are capable of simultaneous operation. This means the GPS patch antenna 109 can operate at the same time as the slot antennas (103 & 105) without any interference between them.

The GPS patch antenna 109 requires additional circuitry to operate. An amplifier circuit is included as part of the GPS patch antenna 109 component. As previously discussed, one advantage to using a printed circuit board material such as FR4 as the base for forming the slot antennas (103 and 105) is that additional circuitry such as the GPS amplifier can be formed directly on the printed circuit board. Additionally, the GPS patch antenna 109 utilizes a second terminal 111 to allow connection to the GPS system of the vehicle.

Figure 2:
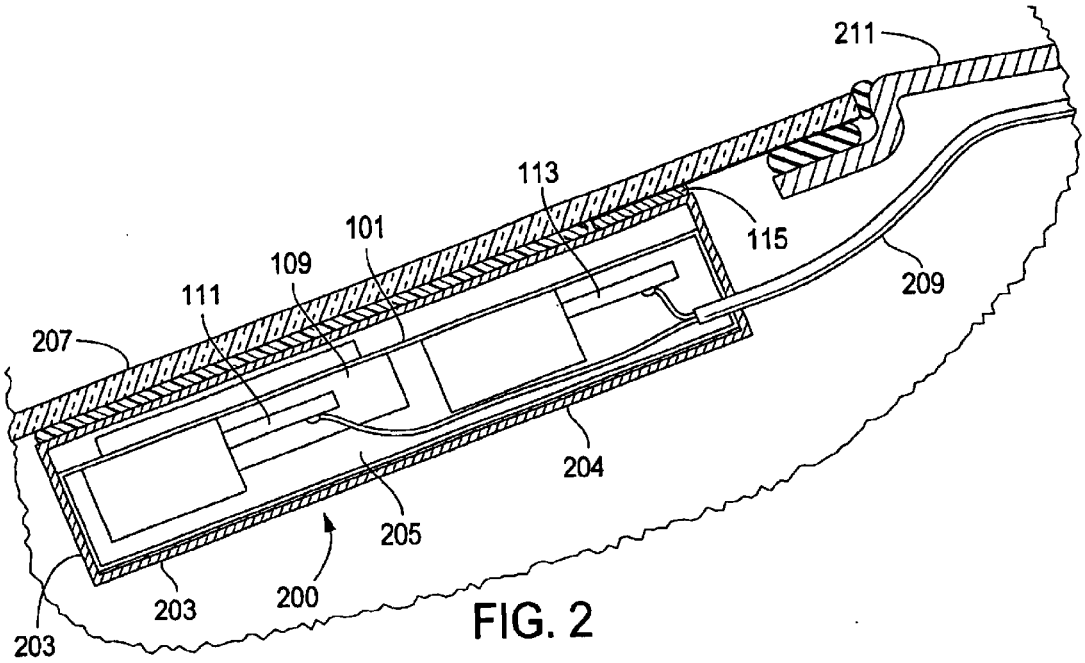
FIG. 2 is a cross-sectional view of an antenna unit in accordance with the present invention in its mounted state.

The antenna face comprising the printed circuit board is mounted to a reflector 203 to form the complete antenna unit 200 as shown in FIG. 2. The reflector 203 can be formed using various types of materials that reflect radiation. In the preferred embodiment, metalized plastic is used to form the reflector 203. The reflector 203 used in the preferred embodiment is formed in the shape of a U-channel. It is shaped such that, when it is attached to the printed circuit board, the shape of the unit is generally rectangular from a cross-sectional view. The U-channel reflector combined with the printed circuit board forms an open ended box with the printed circuit board comprising the face or forward surface of the box and the reflector comprising the top, bottom, and rear walls of the box. A generally rectangular cavity 205 is formed inside of the antenna unit. By using a rectangular shaped reflector, the volume of the cavity 205 is maximized for a given cavity depth, as compared to a using a curved reflector to complete the antenna unit. In addition, using a rectangularly formed reflector maximizes the perpendicular distance from every point on the slot antennas to the back wall of the reflector for a given cavity depth. Each point on the back surface of the reflector is equidistant from the printed circuit board.

In the preferred embodiment, the depth of the reflective cavity 205 is one inch. Thus, the back wall of the reflector 203 is located a distance of approximately 1 inch from the slot antennas, within the range of 0.75 inch to 1.25 inch. This close proximity of the back wall 204 of the reflector 203 relative to the first and second slot antennas (103 and 105) creates an electrically short cavity. A wavelength for a PCS signal is approximately 6" in length, while a wavelength for an AMPS signal is approximately 13" in length. By creating a cavity that is only approximately one inch in depth, the base of the reflector is located within ⅙th of a PCS signal wavelength from the PCS slot antenna and 1/13th of an AMPS signal wavelength from the AMPS antenna. The cavity created in the preferred embodiment of the present invention is significantly shorter electrically than any found within the prior art.

The reflector 203 serves two critical functions. First, the reflector contributes to providing the gain patterns achieved by the antenna. The reflector reflects the radiation originally directed into the vehicle such that it now radiates outward. By shaping or focusing the radiated signal in one direction, the gain achieved by the antenna is increased. By using the slot antennas (103 and 105) in conjunction with the reflector 203, the antenna unit achieves a gain of −3 dB minimum across AMPS and PCS bands, while achieving +3 dBic at zenith in the GPS band.

In addition, the reflector 203 prevents the radiated signals from being radiated into the passenger compartment. While some of the radiated signal can leak into the passenger compartment, approximately 90% of the signal that is radiated backward is reflected forward and outward from the vehicle. This greatly reduces and virtually eliminates the amount of radiated signal to which the occupants of the vehicle are subjected. This phenomena is important today as the FCC has begun to monitor and rate devices in accordance with their Specific Absorption Rate (SAR). A favorable SAR rating is desirable in light of the potential health concerns that have been raised in recent years surrounding exposure to radiated energy.

Figure 3:
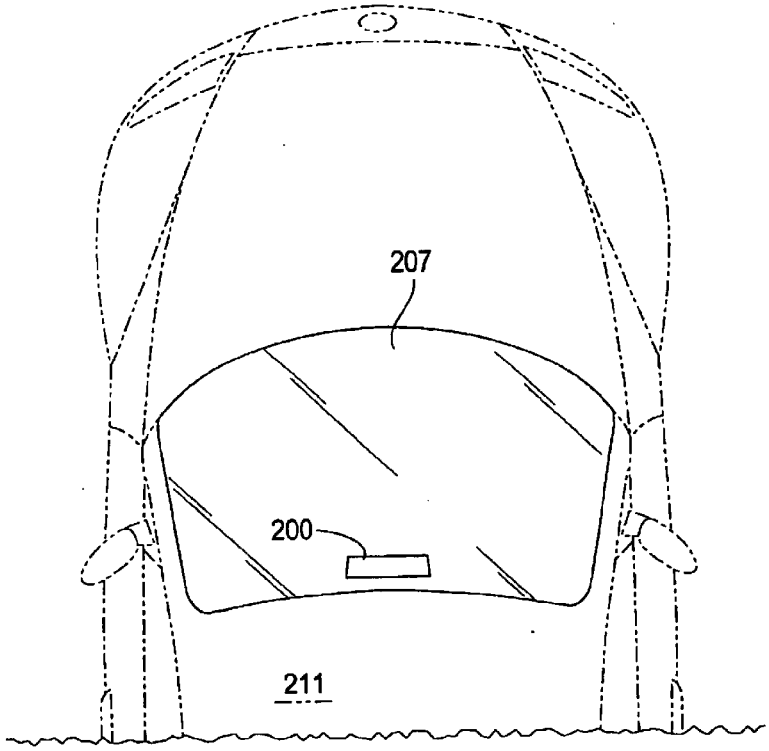
FIG. 3 is a drawing illustrating the position of an antenna unit in accordance with the present invention after it has been installed in a vehicle.
Figure 4:
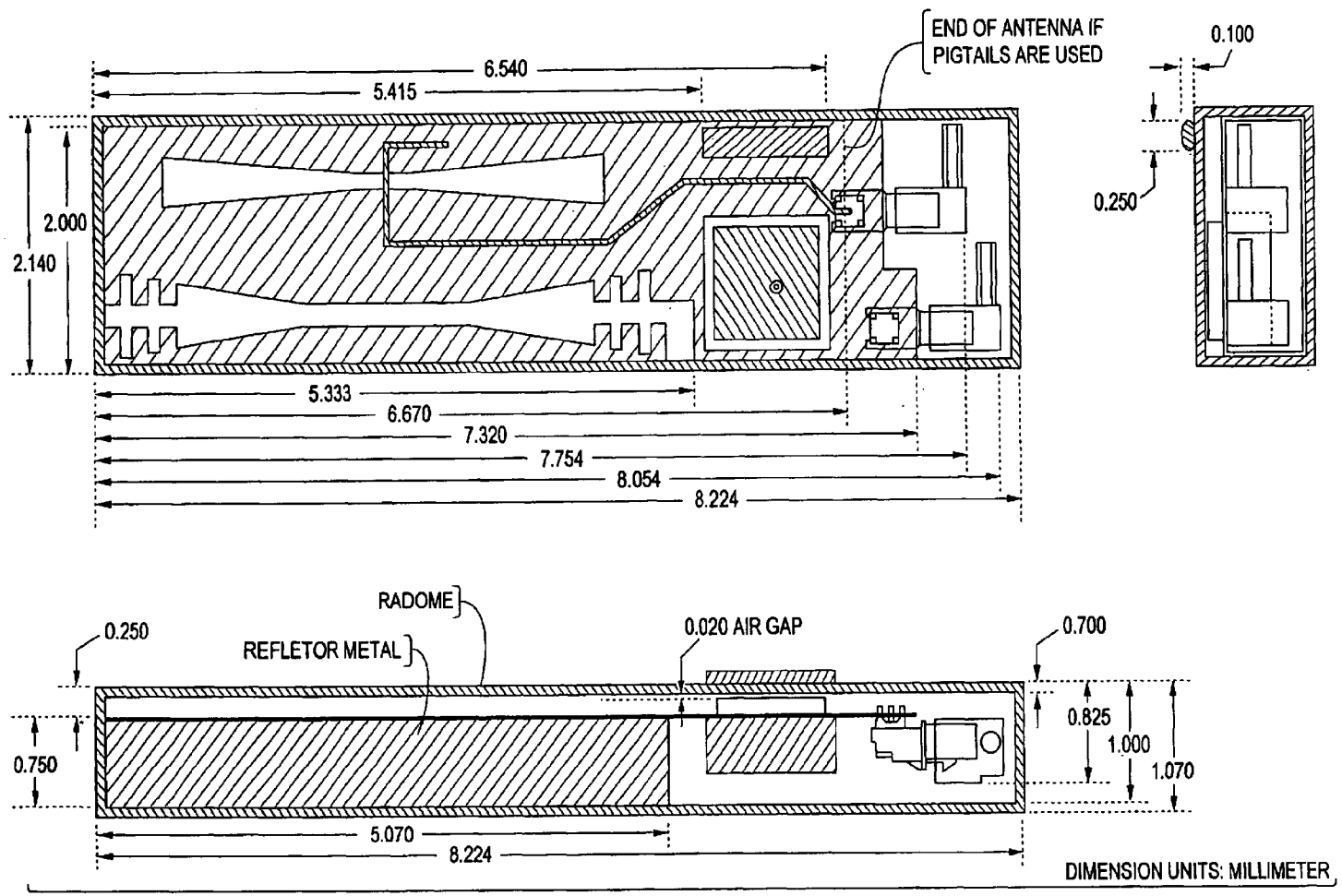
FIG. 4 is an engineering drawing of a preferred embodiment of the invention disclosing all enabling dimensions to construct the best mode of the invention.

In the preferred embodiment, the antenna unit 200 is enclosed in a plastic material for aesthetic purposes and mounted to the top center of the windshield 207 of the vehicle as shown in FIG. 3. The unit is mounted to the windshield 207 inside the passenger compartment with the side of the antenna containing the radiating element 101 placed forward against the windshield glass. The dielectric constant of the windshield glass causes the windshield 207 to have a loading effect upon the antenna. Because of the loading effect achieved from the windshield glass, the antenna unit can be slightly smaller than would be required if the antenna unit was required to operate in free space.

The antenna unit also is conductively coupled to the roof panel 211 of the vehicle upon installation. It is well known that this coupling provides the GPS patch antenna with a wider range of reception. Upon installation of the antenna, a conductive carrier such as a metal strip or a conductive tape can be run from the roof panel 211 to the surface where the antenna will be mounted to provide a contact between the antenna and the roof panel 211. In the preferred embodiment, the antenna unit has a conductive gasket 115 which allows it to contact the conductive carrier. A preferred method of installation is fully described in a related application Ser. No. 10/090,391 entitled "Method of RF Grounding Glass Mounted Antennas to Automotive Frames" and assigned to the same assignee as the present invention filed on even date with the present application and incorporated herein by reference.

Upon installation, the preferred embodiment of the antenna unit is connected to the vehicle communication systems using the terminals located on the antenna face 101. A first terminal 113 allows for connection to the transmission line 107 that drives the slot antennas and a second terminal 111 allows for connection to the GPS patch antenna 109. Using these terminal allows for fast, easy connection of the antenna unit. The connection cables 209 are run underneath the headliner of the vehicle to hide them from view. When the vehicle is built, the antenna can be installed on the windshield prior to the windshield being installed into the vehicle. Upon installation of the windshield into the vehicle, the connection cables 209 can be simply plugged into the antenna.

An alternative embodiment is to eliminate the first terminal 111 and the second terminal 113. The connection between the antenna unit and the connection cables is made using a pigtail configuration. This is basically a direct solder connection between a coaxial cable and the circuit board. This would greatly increase the assembly time to install the units; however, it would allow the overall length dimension of the unit (defined as the dimension of the antenna unit extending along the windshield from left to right or right to left parallel to the ground when the antenna is mounted on the vehicle windshield) to be reduced by the length of the terminal connectors. In certain applications that are extremely space sensitive, this may be desirable.

An antenna unit in accordance with the preferred embodiment of the present invention provides an antenna for the various vehicle communication systems that utilize PCS, AMPS or GPS bands. The antenna unit in accordance with the present invention provides a high gain (−3 dB over the AMPS and PCS bands +3 dBic at zenith in the GPS band), thus making it an efficient antenna for use with today's communication systems.

In addition, the antenna unit in accordance with the present invention is compact and concealed, and designed to be mounted on the front windshield of the vehicle, or alternatively any other glass or non-metalized surface of the vehicle. The small size of the unit prevents it from obstructing the view of the vehicle operator, and the interior mounting of the unit contributes to the aesthetics of the vehicle while at the same time protecting the antenna from damage as a result of exterior elements such as weather or vandalism.

The antenna unit in accordance with the present invention eliminates nearly all of the signal that was radiated into the passenger compartment by antennas used in the prior art. Thus, the vehicle occupants are not subject to the signal radiation, reducing the risk of any potential health hazards caused by exposure to wireless communication radiation.

It should be understood that the foregoing is illustrative and not limiting and that obvious modifications may be made by those skilled in the art without departing from the spirit of the invention. Accordingly, the specification is intended to cover such alternatives, modifications, and equivalents as may be included within the spirit and scope of the invention as defined in the following claims.

What is claimed is:

1. A multi-band antenna for use in conjunction with communication systems, comprising:

a radiating element, said element containing a first slot antenna operating in the PCS frequency band and a second slot antenna operating in the AMPS frequency band;

a reflector, said reflector coupled to said radiating element; and at least one transmission line to feed said first and said second slot antennas;

wherein the radiating element is generally planar and the reflector is U shaped and comprises a generally planar surface parallel to the radiating element and wherein the distance between the generally planar surface of the reflector and the radiating element is a maximum of one-thirteenth of a wavelength for a signal in the AMPS band.

2. A multi-band antenna as set forth in claim 1, wherein the radiating element is comprised of a printed circuit board material.

3. A multi-band antenna as set forth in claim 2, wherein said printed circuit board material is formed of FR4.

4. A multi-band antenna as set forth in claim 1, wherein the radiating element further comprises a GPS patch antenna.

5. A multi-band antenna as set forth in claim 1, wherein the reflector and the radiating element together form a reflecting cavity that is generally rectangular in cross section.

6. A multi-band antenna as set forth in claim 1, wherein the radiating element is generally planar and the reflector is U shaped and comprises a generally planar surface parallel to the radiating element and wherein the distance between the generally planar surface of the reflector and the radiating element is between 0.75 inch and 1.25 inch.

7. A multi-band antenna as set forth in claim 1, wherein the radiating element is generally planar and the reflector is U shaped and comprises a generally planar surface parallel to the radiating element and wherein the distance between the generally planar surface of the reflector and the radiating element is not more than one-sixth of one wavelength for a signal in the PCS band.

8. A multi-band antenna as set forth in claim 1, wherein the amount of a signal from said radiating element that is reflected by said reflector is 90% or greater of the total radiated signal striking said reflector.

9. A multi-band antenna as set forth in claim 2, wherein said transmission line is printed directly on said printed circuit board material.

10. A multi-band antenna as set forth in claim 1, wherein said first slot antenna and the said second slot antenna are parasitically coupled.

11. A multi-band antenna as set forth in claim 10, wherein the width of said multi-band antenna is less than 2.25 inches.

12. A multi-band antenna as set forth in claim 1, wherein said at least one transmission line contains a plug terminal for connection to said communication systems.

13. A multi-band antenna as set forth in claim 4, wherein said at GPS patch antenna contains a plug terminal for connection to said communication systems.

14. A multi-band antenna as set forth in claim 1, wherein the length of said multi-band antenna is less than 8.25 inches.

15. A multi-band antenna as set forth in claim 1, wherein said at least one transmission line is adapted for connection to said communication systems using a pigtail.

16. A multi-band antenna as set forth in claim 15, wherein the length of said multi-band antenna is less than 6.75 inches.

17. A multi-band antenna as set forth in claim 1, wherein said first slot antenna operating in the PCS frequency band achieves a gain of −3 dB or greater.

18. A multi-band antenna as set forth in claim 1, wherein said second slot antenna operating in the AMPS frequency band achieves a gain of −3 dB or greater.

19. A multi-band antenna as set forth in claim 4, wherein said GPS patch antenna achieves a gain of −3 dB or greater.

20. A multi-band antenna as set forth in claim 1, wherein said multi-band antenna uses vertical polarization as a primary mode of reception.

21. A multi-band antenna as set forth in claim 20, wherein said multi-band antenna contains a horizontal polarization component.

22. A multi-band antenna as set forth in claim 1, wherein said multi-band antenna is mounted to a front windshield in a vehicle.

23. A multi-band antenna as set forth in claim 22, wherein said vehicle has a roof portion and said multi-band antenna is electrically coupled to said roof portion.

24. A multi-band antenna as set forth in claim 22, wherein said vehicle has a passenger compartment and wherein the amount of a signal radiated by said radiating element that enters said passenger compartment is less than 10% of the total radiated signal.

25. A multi-band antenna as set forth in claim 1 wherein said reflector forms a rectangular reflection cavity together with said radiating element.

* * * * *